US007677067B2

(12) United States Patent
Riznik et al.

(10) Patent No.: US 7,677,067 B2
(45) Date of Patent: Mar. 16, 2010

(54) LOCK

(75) Inventors: Peter Riznik, Tillmitsch (AT); Karl Haidic, Hengsberg (AT)

(73) Assignee: Roto Frank AG, Leinfelden-Echterdingen (DE)

( * ) Notice: Subject to any disclaimer, the term of this patent is extended or adjusted under 35 U.S.C. 154(b) by 153 days.

(21) Appl. No.: 11/713,072

(22) Filed: Feb. 28, 2007

(65) Prior Publication Data

US 2008/0202175 A1 Aug. 28, 2008

(51) Int. Cl.
*E05B 59/00* (2006.01)

(52) U.S. Cl. ..... 70/107; 70/149; 70/472; 292/35

(58) Field of Classification Search ..... 70/107–111, 70/149, 150, 472, 486; 292/34–37, 165–167
See application file for complete search history.

(56) References Cited

U.S. PATENT DOCUMENTS 3,808,849 A * 5/1974 Alexander ..... 70/149
5,265,920 A * 11/1993 Kaup et al. ..... 292/40
6,125,670 A * 10/2000 Fuss et al. ..... 70/107
6,209,364 B1 * 4/2001 Collet et al. ..... 70/107
6,324,876 B1 * 12/2001 Prevot et al. ..... 70/107
6,813,915 B2 * 11/2004 Chang ..... 70/107
2003/0159478 A1 * 8/2003 Nagy ..... 70/107
2005/0092040 A1 * 5/2005 Chuang ..... 70/107
2006/0123859 A1 * 6/2006 Gonzalez ..... 70/107
2007/0113603 A1 * 5/2007 Polster ..... 70/107
2008/0156049 A1 * 7/2008 Topfer ..... 70/107

* cited by examiner

*Primary Examiner*—Suzanne D Barrett
(74) *Attorney, Agent, or Firm*—Friedrich Kueffner

(57) ABSTRACT

In a lock of a door or a window with a basic lock and at least an auxiliary locking device and at least a first actuation arrangement for locking the lock, a second actuation arrangement separate from the first actuation arrangement is provided for unlocking the lock.

20 Claims, 7 Drawing Sheets

LOCK

BACKGROUND OF THE INVENTION

1. Field of the Invention

The invention relates to a lock of a door, a window or such like with a basic lock and at least an auxiliary locking device, as well as at least a first actuation arrangement for locking the lock.

2. Description of the Related Art

In some countries it is customary to use a thumb activated handle set for pulling back the latch. For locking the door a round cylinder is used as a rule. Unlocking is also performed by way of the round cylinder. If such locks are to be expanded by an auxiliary locking device the force that can be introduced by way of the thumb activated door handle or the round cylinder is not enough to lock out the auxiliary locking device (s). It is aggravating in addition that it is usual in these countries to turn the cylinder only approximately 90° while in other countries, in which auxiliary locking devices are more customary, a cylinder can be turned by 720° to extend the auxiliary locking device(s) and the bolt of a basic lock.

SUMMARY OF THE INVENTION

The object of the present invention is to provide help in this regard.

According to the invention, this object is solved in a simple and surprising way through a lock of the type mentioned at the outset in that a second actuation arrangement, which is separate from the first actuation arrangement, is provided for unlocking the lock. Locking and unlocking can be decoupled as a result. The actuation arrangement for locking can be designed so that with it greater forces can be introduced, while the second actuation arrangement for unlocking can be designed such that unlocking can be performed with less effort. Through this measure it is possible to use basic locks that can be operated similar to previously known locks in combination with an auxiliary locking device. Preferably the basic lock has a bolt.

It is particularly preferable if the first actuation arrangement comprises a handle, preferably on the outside, which interacts with a first nut. By way of the handle it is possible to exert a relatively large force for unlocking the lock, more preferably to extend the bolt and the latch of a basic lock and one or several auxiliary locking devices.

With a preferred development it can be provided that the handle is part of a thumb activated handle set. The handle can be so designed that it looks like a handle customarily used with thumb activated handle sets, but which, in the state of the art, is fixed and only used for pulling the door closed. With the lock according to the invention it is arranged so that it can be moved, more preferably swiveled or turned.

The second actuation arrangement can comprise a cylinder. A cylinder can be operated relatively easily from the outside through a key. A knob can be provided on the inside to actuate the cylinder from the inside. Alternatively it can be provided that a key is required also from the inside to actuate the cylinder. If with an embodiment the pushrod is not automatically locked after the bolt, latch and/or auxiliary locking devices have been extended, it can be provided that the pushrod is locked through actuation of the cylinder of the second actuation arrangement. For example, the cylinder can drive a locking slide which blocks a pushrod interacting with the locking devices.

The cylinder in this case is capable of being turned by approximately 90°.

With a particularly preferred embodiment it can be provided that the cylinder is designed as a profile cylinder. The cylinder cam of the profile cylinder can transmit considerably more force than the cylinder pin of a round cylinder which can break when greater force is introduced.

In a preferred design of the invention it can be provided that the bolt and/or the auxiliary locking device are designed wedge-shaped. Through the wedge-shaped development a leaf/casement, to which the lock according to the invention is attached, can on the one hand be pulled against a frame during locking. On the other hand the wedge shape facilitates the pulling out of the bolt or the auxiliary locking device(s) from assigned locking pieces during unlocking.

With a further alternative embodiment it can be provided that the bolt and/or the auxiliary locking device(s) are designed as a circular tongue. A circular tongue can also be actuated with little effort.

It is particularly advantageous if at least a resetting element that acts on the pushrod and supports the unlocking movement of the pushrod is provided. This is more preferably advantageous when with the first actuation arrangement greater force can be exerted than with the second actuation arrangement for unlocking. Unlocking is facilitated if a supporting resetting element is provided.

In preferred development of the invention it can be provided that the first actuation arrangement has an outer nut wherein a first nut part can be driven by the handle and interacts with a pushrod controlling the lock and a second nut part can be driven by a handle and interacts with a latch. This development allows it to actuate the lock with a thumb activated handle set both for locking as well as for retracting the latch. The basic lock in which the bolt is arranged can be connected with the auxiliary locking devices by way of the face plate and a pushrod each located behind the face plate, which is moveably coupled with the pushrod of the basic lock.

Further advantages are obtained if a third actuation arrangement is provided that interacts with an internal nut by way of which the pushrod can be driven. By way of the inner nut it is possible to lock, retract the locking devices, retract the latch and realize a possibly present panic function. The third actuation arrangement can have a handle, a knob or similar.

If a panic function is realized, i.e. it is possible from the inside to retract all bolts, auxiliary locking devices and the latch without a key with only one actuation facility, there is a risk that a locked door is also opened through children or dogs. To exclude this it is advantageous if the panic function can be switched on and off.

With a further development a locking slide, by way of which the pushrod can be locked in a locking position, can be moved through the inner nut. Through this measure it is possible to open the lock even without actuating the cylinder. Through this measure a panic function is realized so that the lock can always be opened from the inside of a building if required.

It is particularly advantageous if the inner nut and the locking slide can be uncoupled. Through this measure the panic function can be "switched off". This can be necessary for example if children are present in a building and it is not desired that these children can open a door in which the lock is arranged.

The switching on and switching off of the panic function can be realized in a particularly simple manner in that a bolt driver that can at least be moved between two defined positions is arranged on the locking slide wherein the locking slide in a first position can be moved through the inner nut and the locking slide in a second position cannot be moved through the inner nut With the lock according to the invention the panic function, with installed lock, can be switched on and off for example in that the bolt driver is actuated with an Allen key from the front of the lock (face plate side).

With a preferred embodiment it can be provided that the pushrod is designed at least in two parts wherein the pushrod parts can be moved relative to each other within limits. Here, the one pushrod part can be designed as a rack intermeshing with a cylinder gear of the cylinder. The inner knob or handle on the cylinder gear can consequently serve to indicate the locking status. Since the cylinder gear is driven via the pushrod during locking it is moved in a certain angle of rotation. For example in the United States of America an exact indication of 90° is necessary. To bring the cylinder nut into this state and reliably indicate the locking status it is advantageous to design the pushrod in two parts and arrange the rack so that it can move within limits on the other pushrod part.

This function can be supported in that the rack is supported on the other pushrod part by way of a compensation spring. The compensation spring can also contribute to reducing the effort during unlocking.

Further features and advantages of the invention are evident from the following description of exemplary embodiments of the invention, by means of the figures of the drawing which show details essential to the invention and from the claims. With a version of the invention the individual features can each be realized individually for themselves or several in any combination.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
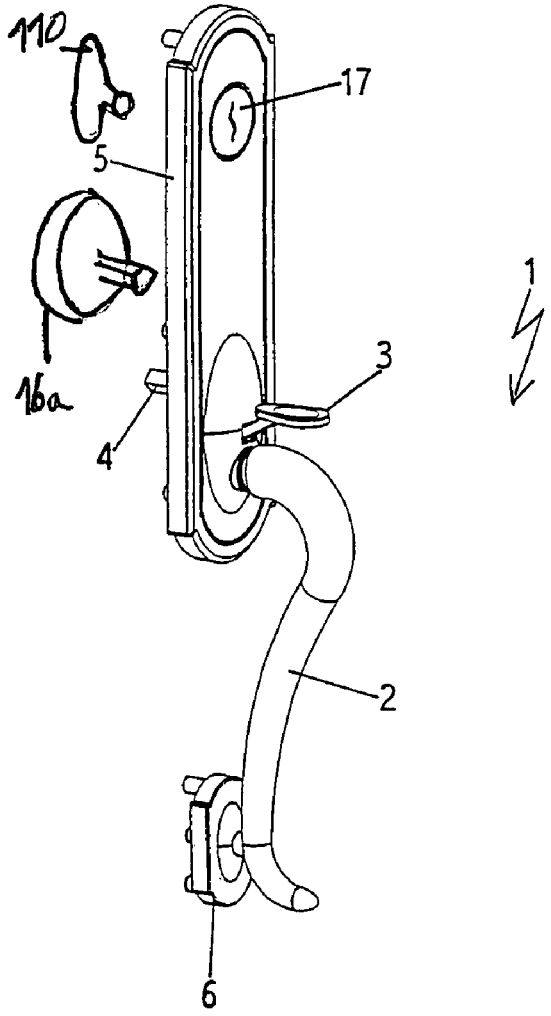
FIG. 1 is a perspective view showing an outside thumb activated handle set in a basic position.

FIG. 1 shows a thumb activated handle set 1 in a basic position. A first actuation arrangement comprises a handle 2, by means of which a bolt and at least an auxiliary locking device can be brought into a locking position. Above the handle 2 a thumb activated handle 3 is arranged by way of which a latch can be pulled back. Both the handle 2 and the thumb activated handle 3 interact with and can drive a nut square 4. The thumb activated handle set 1 comprises a casing 5 into which a cylinder 17 protrudes from the lock side, which is part of a second actuation arrangement. At the bottom the handle 2 strikes a stop 6. The thumb activated handle set 1 is suitable for left and right door attachment. For this purpose the stop 6 at the bottom can be turned. To prevent a lifting of the handle 2 and a turning away of the handle 2 over the stop 6, which with a panic function would result in an opening of the locking devices, a stop piece is provided in the casing 5.

Figure 2:
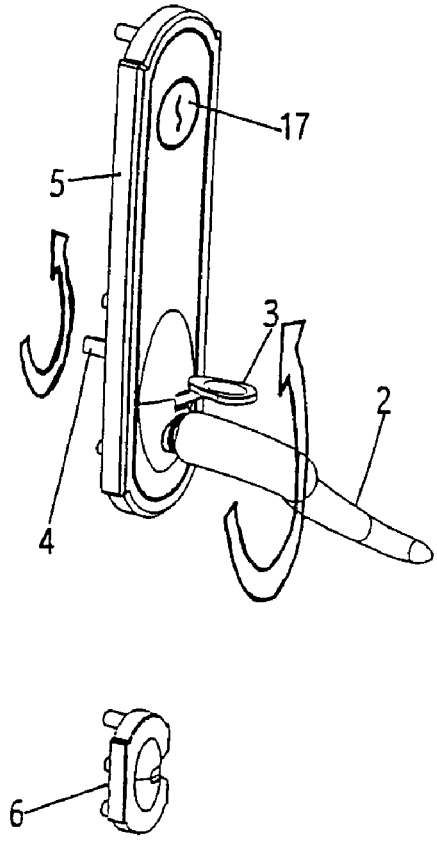
FIG. 2 is an exploded sectional view showing the thumb activated handle set of FIG. 1 during locking.

In FIG. 2 it is shown how the handle 2 is swiveled for locking. After completed locking it can be returned to its basic position.

Figure 3:
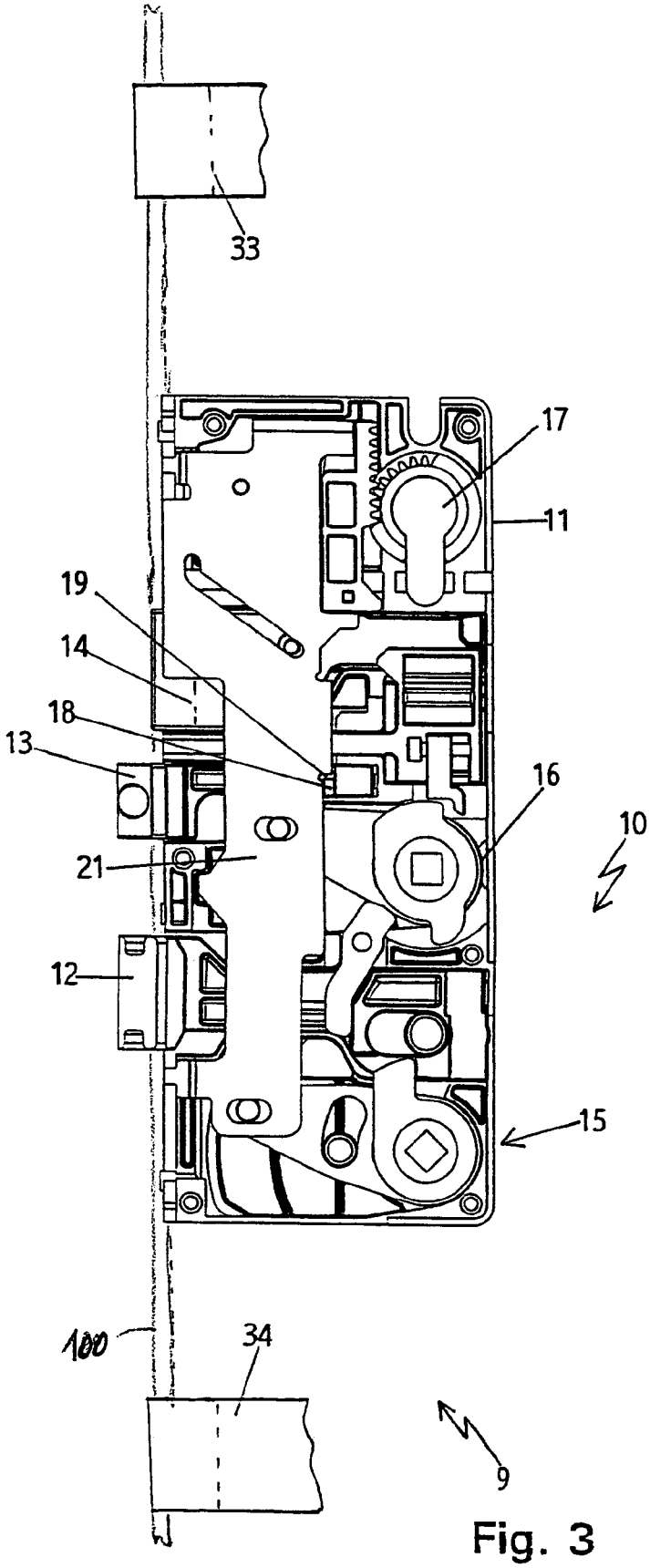
FIG. 3 is an exploded sectional view showing a lock according to the invention in a basic position (lock open, leaf/casement open)

The FIG. 3 shows a lock 9 with a basic lock 10 in a basic position with opened leaf/casement with removed cover plate of the basic lock casing 11. The basic lock 10 has a latch 12, a locking latch 13 and a bolt 14. For actuation it has an outer nut 15, which interacts with the handle 2 and the thumb activated handle 3, an inner nut 16, which interacts with a third actuation arrangement that is not shown, and the cylinder 17. In the basic position shown the latch 12 is extended, the bolt 14 retracted and the locking latch 13 likewise extended. The extended locking latch 13 engages under a lug 18 in a projection 19 of the pushrod 21 so that the latter cannot be moved down. Locking with opened leaf/casement of a window, a door or similar to which the lock 9 is mounted, is thus prevented.

Figure 4:
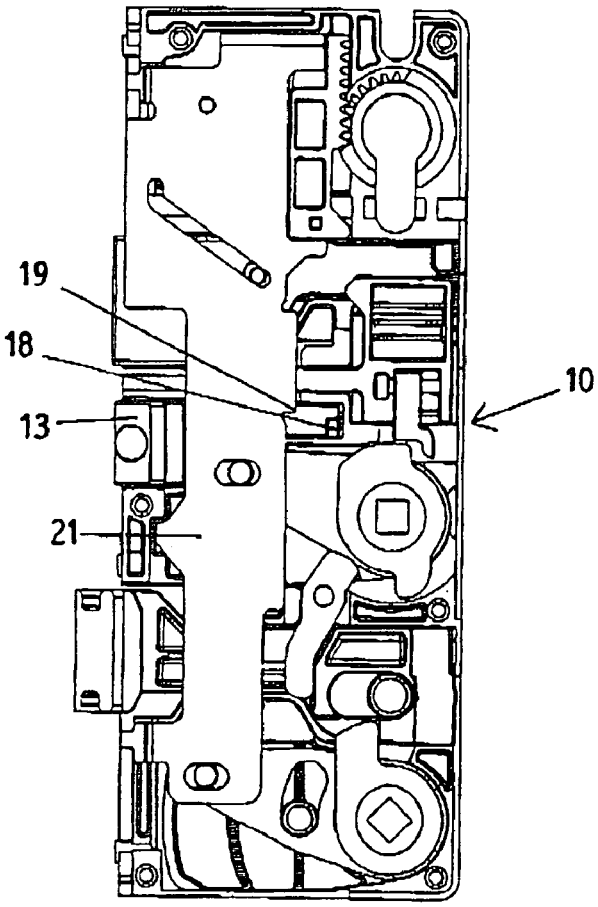
FIG. 4 is a sectional view showing the open lock with leaf/casement closed.

The FIG. 4 shows the situation with closed leaf/casement. The locking latch 13 is displaced into the basic lock 10 during the closing of the leaf/casement through a fixed frame or a closing plate so that the lug 18 releases the projection 19. The pushrod 21 is thus free for a downward movement.

The pushrod 21 is movement-coupled with auxiliary locking devices 33, 34 so that these can be extended and retracted jointly with the bolt 14. In the following figures only the basic lock 10 of the lock 9 is shown for reasons of simplification.

Figure 5:
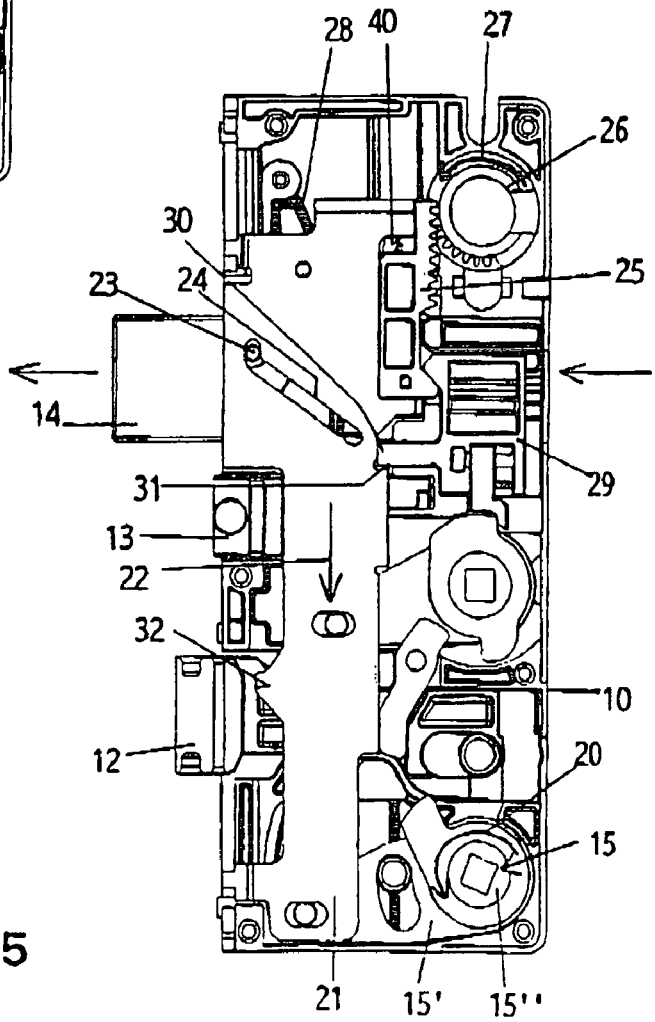
FIG. 5 is a sectional view showing the lock with closed leaf/casement during locking.

In the following it is shown by means of FIG. 5 how the basic lock 10 is locked. A first actuation arrangement for example comprising a handle 2 is actuated with the leaf/casement closed (locking latch 13 retracted), as a result of which the nut parts 15', 15" of the outer nut 15 are turned anti-clockwise, which is indicated by the arrow 20. As a result, the pushrod 21 movement-coupled with the nut part 15' of the outer nut 15 is moved downward in the direction of the arrow 22. With this movement a control pin 23 of the bolt 14 is moved along the cam 24 of the pushrod 21 so that the bolt 14 is extended. At the same time, the latch 12 is blocked through the section 32 of the pushrod 21.

Through the downward movement of the pushrod 21 a rack 25, which is supported by the pushrod 21 by way of a compensation spring 40, is also driven downwards wherein the rack 25 intermeshes with a cylinder gear 26 so that the latter is turned anti-clockwise by 90° according to arrow 27. The rack 25 is considered part of the pushrod 21 so that it is a two-piece pushrod.

With the downward movement of the pushrod 21 a resetting element 28 designed as lifting spring as additionally loaded. The locking slide 29 with its free end 30 blocks the pushrod 21 in that the free end 30 engages over a projection 31 of the pushrod, in this way preventing a movement against the direction of the arrow 22. With closed leaf/casement the lock 9 is therefore bolted and locked.

Figure 6:
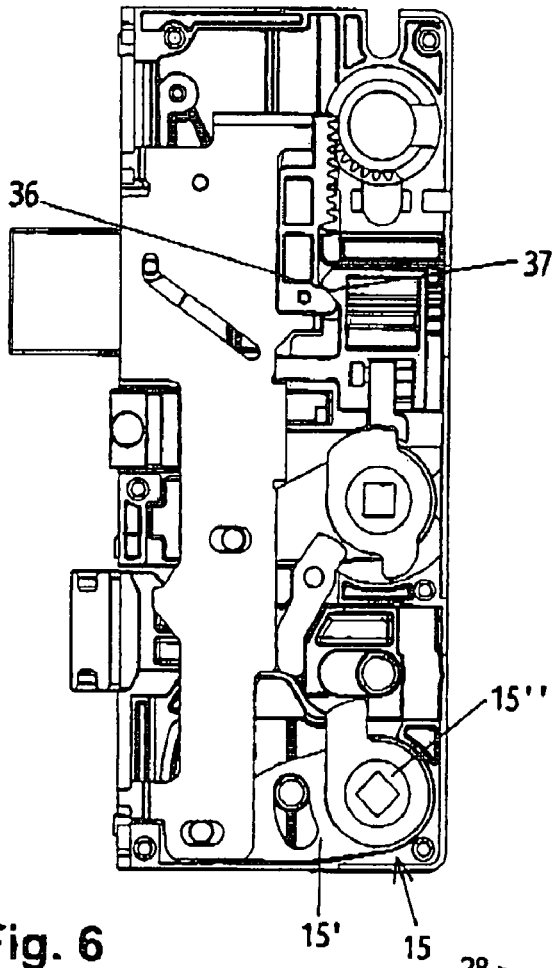
FIG. 6 is a sectional view showing the lock with closed leaf/casement towards the end of the locking operation.

As is evident from FIG. 6 the handle 2 of the first actuation arrangement can again be returned to a basic position as a result of which the second nut part 15' of the outer nut 15 is also moved back in clockwise direction. The first nut part 15' remains in its locked position.

Figure 7:
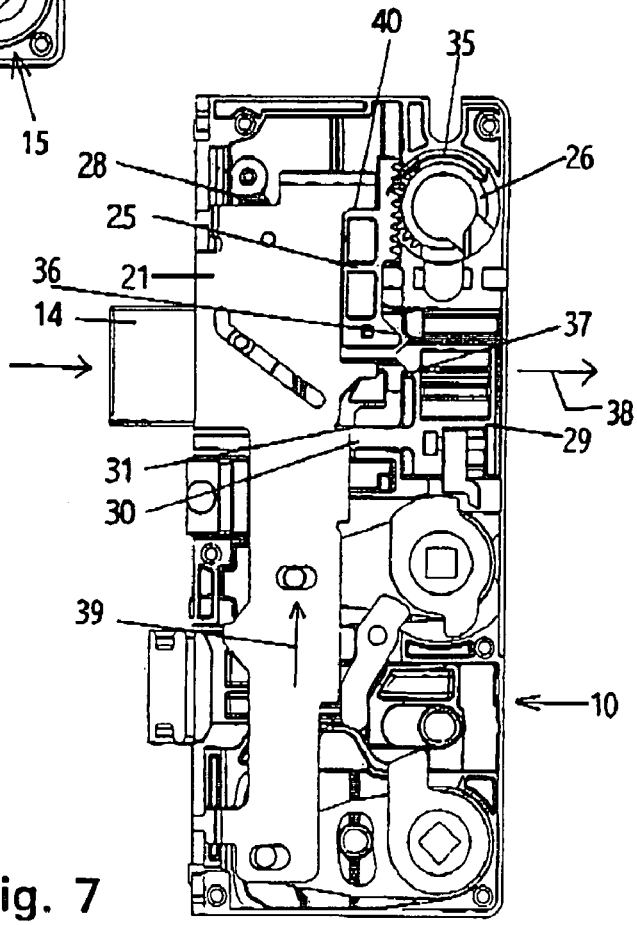
FIG. 7 is a sectional view showing a presentation for illustrating the unlocking of the lock.

The opening of the locked basic lock 10 is explained by means of FIG. 7. At first, the cylinder gear 26 is turned clockwise with a key according to arrow 35. As a result, the rack 25 is moved up and the compensation spring 40 compressed. In the process, the two inclines 36, 37 slide along each other so that the locking slide 29 is relocated in the direction of the arrow 38 and releases the projection 31 of the pushrod 21. In the shown position the lug 18 is in contact with the pushrod 21 without blocking it. After this, the rack 25 drives the pushrod 21 up with it in the direction of the arrow 39. As a result, the bolt 14 and all auxiliary locking devices 33, 34 are retracted. The upward movement of the pushrod 21 and thus the retraction of the bolt 14 and the auxiliary locking facilities element 28 are carried out by a lifting spring and a compensation spring 40 acting between the rack 25 and the pushrod 21. The compensation spring 40 relaxes when the rack 25 is in an upper end position and thereby additionally moves the pushrod 21 a little up, so that all bolts 14 and auxiliary locking devices are completely retracted. As a result, the lock 9 can be unlocked with a minor cylinder rotation of only approximately 90°. The compensation spring 40 is required since a part of the cylinder rotation is required to move the locking slide 29 back. The lock 9 is now opened but the leaf/casement is closed. Additionally, the compensation spring 40 moves the cylinder knob into the 90° indicating position during expansion. Thereby the knob serves as "open-locked" indicator.

Figure 8:
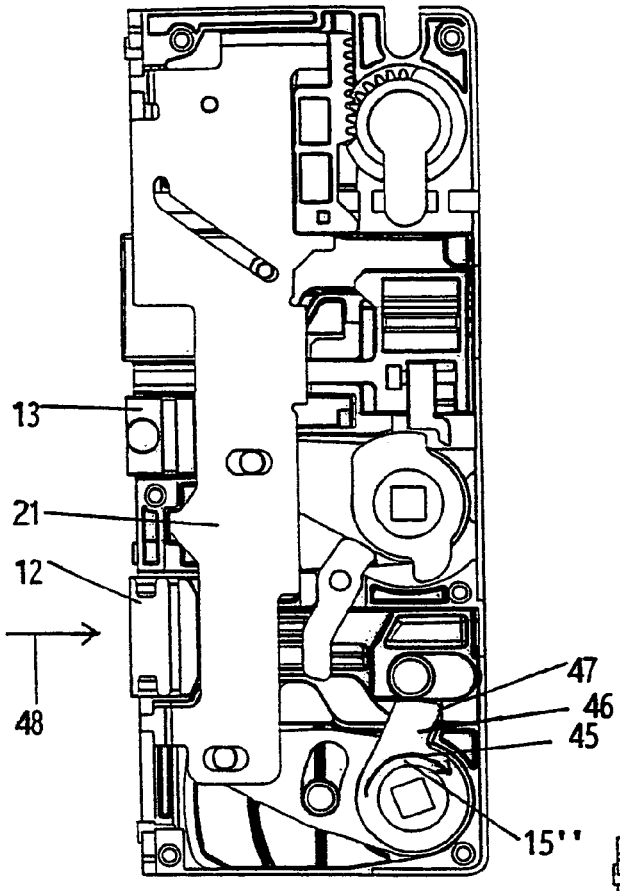
FIG. 8 is a sectional view showing a presentation to explain the pulling of the latch from the outside.

By means of FIG. 8 it is shown how the latch 12 is retracted from the outside with the lock 9 opened. A thumb activated handle 3 of a thumb activated handle set 1 is actuated for example. This causes the second nut part 15" to rotate in the direction of the arrow 45 so that a projection 46 engages with a corresponding stop 47 of the latch 12, retracting the latter in the direction of the arrow 48. The leaf/casement can now be opened. In the position shown the pushrod 21 is in its basic position and the bolt 14 and the auxiliary locking devices 33, 34 are retracted. The resetting element 28 and the compensation spring 40 are relaxed.

If the leaf/casement is now opened the locking latch 13 is extended. Once the thumb activated handle 3 is released the latch 12 returns to its starting position because of a resetting force. The second nut part 15" is moved back similarly.

Figure 9:
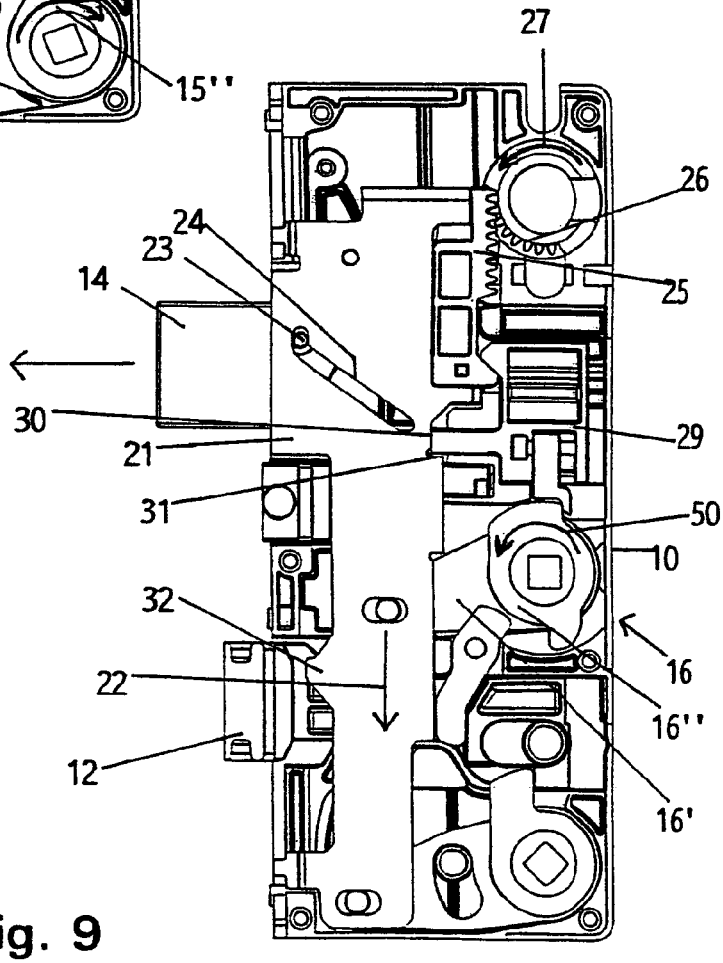
FIG. 9 is a sectional view showing a presentation of the lock to explain the locking of the lock from the inside.

By means of FIG. 9 it is explained how the lock 9, starting from the situation shown in FIG. 4 (lock 9 is open, leaf/casement is closed) the lock 9 is locked from the inside. A third inner actuation arrangement for example having a handle or knob is actuated with the leaf/casement closed (locking latch 13 retracted), as a result of which the nut parts 16', 16" of the inner nut 16 are rotated anti-clockwise, which is indicated by the arrow 50. As a result, the pushrod 21 movement-coupled with the nut part **16*r* of the inner nut 16 is moved down in the direction of the arrow 22. With this movement, the control pin 23 of the bolt 14 is moved along the cam 24 of the pushrod 21 so that the bolt 14 is extended. The latch 12 is blocked through the pushrod section 32**.

Through the downward movement of the pushrod 21 the rack 25 is also driven downward, wherein the rack 25 intermeshes with a cylinder gear 26 so that the latter is turned anti-clockwise by 90° according to the arrow 27.

During the downward movement of the pushrod 21 the resetting element 28 designed as lifting spring is additionally loaded. The locking slide 29 with its free end 30 blocks the pushrod 21 in that the free end 30 engages over the projection 31 of the pushrod 21, in this way preventing a movement against the direction of the arrow 22. The lock 9 is therefore bolted and locked with the leaf/casement closed.

Figure 10:
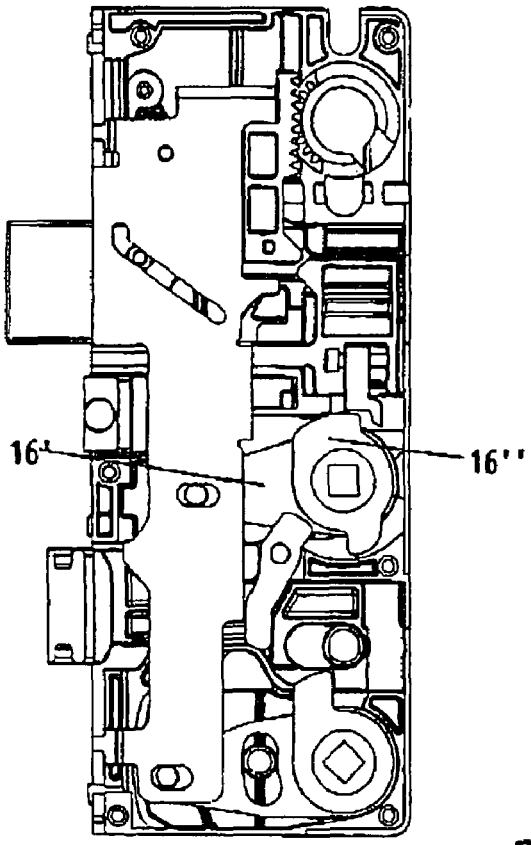
FIG. 10 the lock towards the end of the locking operation during locking from the inside.

As is evident from FIG. 10 the inner actuation arrangement (handle or knob) can be returned to a basic position after completed locking, as a result of which the second nut part 16" of the inner nut 16 is moved back in clockwise direction. The first nut part 16' remains in its locking position.

Unlocking the lock 9 from inside corresponds to unlocking from outside according to FIG. 7 the difference being that the cylinder 17 is actuated from inside with a key or a knob.

Figure 11:
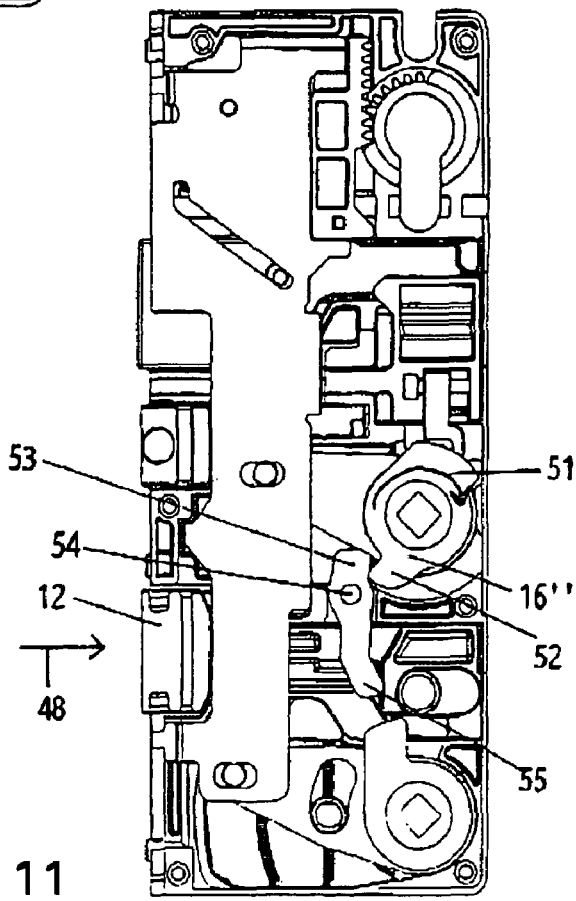
FIG. 11 is a sectional view showing a presentation for explaining the pulling of the latch from the inside.

By means of FIG. 11 it is shown how the latch 12 is retracted with the opened lock 9. For example a handle of the inner actuation arrangement is actuated, as a result, the second nut part 16" is turned in the direction of the arrow 51. The projection 52 acts on a lever 53 so that the latter is swiveled around its fulcrum 54. The opposite end 55 of the lever 53 acts on the latch 12, moving the latter back in the direction of the arrow 48. Once the leaf/casement has been opened the handle is released. The second nut part 16" and the latch 12 move into their basic position as shown in FIG. 3. The lock 9 and the leaf/casement are now open.

Figure 12:
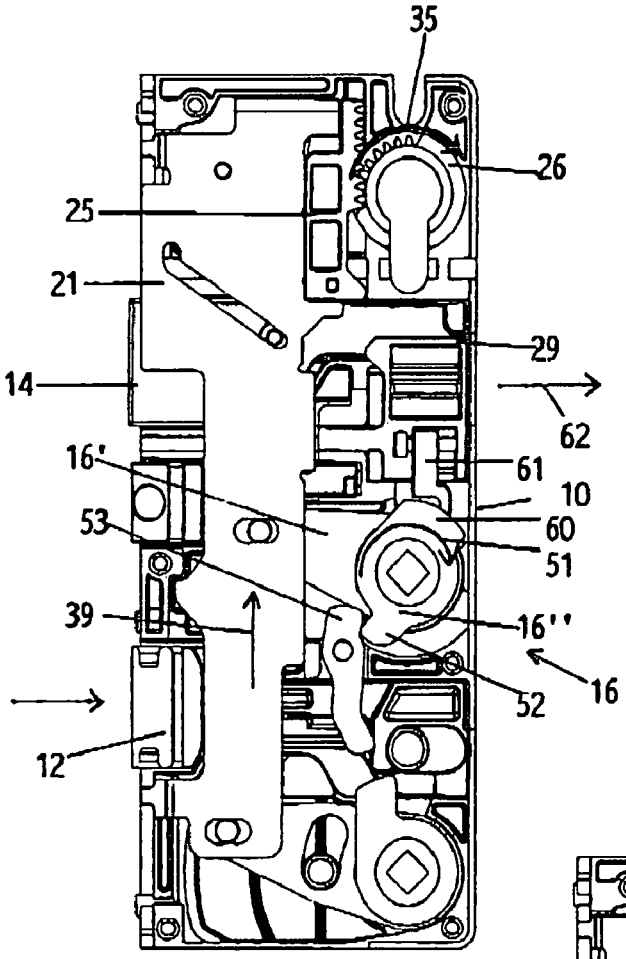
FIG. 12 is a sectional view showing a presentation of the lock to explain a panic function.

A panic function of the lock 9 is explained by means of FIG. 12. The panic function makes it possible to unlock the lock 9 from the inside by way of the inner nut 16 and also to retract the latch 12. The handle of the inner actuation arrangement is actuated as a result of which the second nut part 16" is turned in the direction of the arrow 51. As a result, the projection 60 acts on a lock driver 61 so that the lucking slide 29 is moved in the direction of the arrows 62 so that the latter releases the pushrod 21 for a movement 10 the direction of the arrow 39. Through a further movement of the second nut part 16" in the direction of the arrow 51 the first nut part 16' is also driven in the direction of the arrow 51 so that the pushrod 21 is moved in the direction of the arrow 39. As a result, the bolt 14 and the auxiliary locking devices 33, 34 are retracted and the latch 12 is released through the pushrod 21, at the same time, the projection 52 acts on the lever 53 as a result of which the latch 12 is retracted as described above. Through the pushrod 21 the rack 25 is also driven upwards so that the cylinder gear 26 rotates in the direction of the arrow 35. The lock 9 is now open, the leaf/casement is closed but can be opened.

Figure 13:
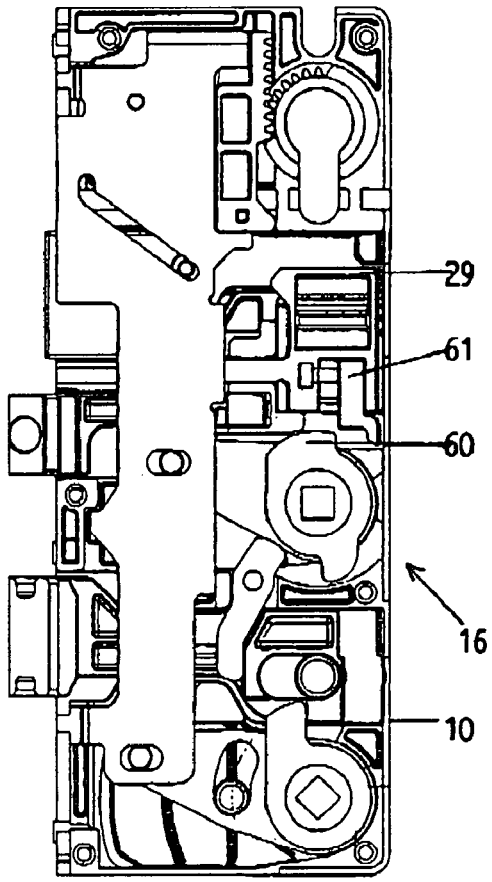
FIG. 13 is a sectional view showing a presentation of the lock to explain the switching-off of the panic function.

As is shown in FIG. 13 the panic function can be disabled. The lock driver 61 is able to assume two defined positions wherein in FIG. 12 a first position relative to the locking slide 29 and a second, rear position relative to the locking slide 29 are shown in FIGS. 12 and 13 respectively. In the position shown in FIG. 13 the projection 60 of the nut part 16" can no longer act on the bolt driver 61.

It is therefore not possible by way of the inner nut 16 to unlock the lock 9. Switching the panic function on and off with the installed lock 9 is possible through the face plate.

While specific embodiments of the invention have been shown and described in detail to illustrate the inventive principles, it will be understood that the invention may be embodied otherwise without departing from such principles.

We claim:

1. A lock of a door, a window or such like, comprising a basic lock and at least an auxiliary locking device, and at least a first actuation arrangement for locking the lock, further comprising a second actuation arrangement separate from the first actuation arrangement for unlocking the lock, wherein the first actuation arrangement includes an outer nut having a first nut part that is driven by an outside first handle and interacts with a pushrod that controls a bolt, and a second nut part that is driven by an outside second handle and interacts with a latch.

2. The lock according to claim 1, wherein the basic lock has a bolt.

3. The lock according to claim 1, wherein the first actuation arrangement comprises an outside handle which interacts with a first nut.

4. The lock according to claim 3, wherein the handle is part of a thumb activated handle set.

5. The lock according to claim 1 the second actuation arrangement comprises a cylinder.

6. The lock according to claim 5, wherein the cylinder can be rotated by approximately 90°.

7. The lock according to claim 5, wherein the cylinder is designed as a profile cylinder.

8. The lock according to claim 2, wherein the bolt is designed wedge-shaped.

9. The lock according to claim 1, wherein the auxiliary locking device(s) are designed wedge-shaped.

10. The lock according to claim 1, wherein at least one resetting element acting on a pushrod, supporting a unlocking movement of the pushrod, is provided.

11. The lock according to claim 1, wherein a third actuation arrangement is provided which interacts with an inner nut.

12. The lock according to claim 1, wherein a panic function can be switched on and off from a face plate side with the lock installed.

13. The lock according to claim 11, wherein a locking slide can be moved through the inner nut so as to lock the pushrod in a locking position.

14. The lock according to claim 13, wherein the inner nut and the locking slide can be decoupled.

15. The lock according to claim 13, wherein a bolt driver, that can at least be moved between two defined positions, is arranged on the locking slide, wherein the locking slide can be moved in the inner nut in a first position and the locking slide cannot be moved in a second position in the inner nut.

16. The lock according to claim 15, wherein the bolt driver can be actuated from a face plate side with the lock installed.

17. The lock according to claim 10, wherein the pushrod is at least a two-part design wherein the pushrod parts can be moved within limits relative to each other.

18. The lock according to claim 10, wherein a pushrod part is designed as a rack intermeshing with a cylinder gear of a cylinder.

19. The lock according to claim 18, wherein the rack is supported by another of the pushrod parts by way of a compensation spring.

20. Lock according to claim 19, wherein the compensation spring is designed as a compensation element, and a cylinder knob on the inner door side thereby serves as an open-locked-indicator.

* * * * *